US009339683B2

(12) United States Patent
Dilli et al.

(10) Patent No.: US 9,339,683 B2
(45) Date of Patent: May 17, 2016

(54) COMPACT TREADMILL WITH WALKER

(71) Applicant: Mobility Research, Inc., Tempe, AZ (US)

(72) Inventors: Dave Dilli, Phoenix, AZ (US); Mohammed Ehsan, Phoenix, AZ (US); Amir Seif, Phoenix, AZ (US); Ryan Bellman, Tempe, AZ (US)

(73) Assignee: Mobility Research, Inc., Tempe, AZ (US)

( * ) Notice: Subject to any disclaimer, the term of this patent is extended or adjusted under 35 U.S.C. 154(b) by 0 days.

(21) Appl. No.: 14/499,962

(22) Filed: Sep. 29, 2014

(65) Prior Publication Data

US 2016/0089563 A1 Mar. 31, 2016

(51) Int. Cl.

| | |
|---|---|
| ***A63B 22/02*** | (2006.01) |
| ***A63B 22/00*** | (2006.01) |
| ***A63B 23/04*** | (2006.01) |
| ***A63B 21/00*** | (2006.01) |

(52) U.S. Cl.

CPC ..... *A63B 22/0046* (2013.01); *A63B 21/00018* (2013.01); *A63B 22/0235* (2013.01); *A63B 23/0405* (2013.01)

(58) Field of Classification Search

USPC ..... 482/1–148

See application file for complete search history.

(56) References Cited

U.S. PATENT DOCUMENTS

| | | | | | |
|---|---|---|---|---|---|
| 5,162,029 | A * | 11/1992 | Gerard | A63B 22/02 | 198/861.1 |
| 6,123,646 | A * | 9/2000 | Colassi | A63B 22/0235 | 482/54 |
| 6,347,603 | B1 * | 2/2002 | Felger | A01K 15/027 | 119/700 |
| 6,471,622 | B1 * | 10/2002 | Hammer | A63B 22/0023 | 482/51 |
| RE39,180 | E * | 7/2006 | Colassi | A63B 22/0235 | 482/54 |
| 8,900,101 | B2 * | 12/2014 | Stack | A63B 71/022 | 119/700 |
| 8,920,347 | B2 * | 12/2014 | Bayerlein | A63B 22/0235 | 482/54 |
| 9,044,636 | B2 * | 6/2015 | Hao | A63B 22/0015 | |
| 9,220,940 | B2 * | 12/2015 | Al Kuwari | A63B 22/0285 | |
| 2005/0183759 | A1 * | 8/2005 | Wolfe | A61H 3/04 | 135/67 |
| 2015/0087484 | A1 * | 3/2015 | Bayerlein | A63B 22/0235 | 482/54 |

* cited by examiner

*Primary Examiner* — Stephen Crow

(74) *Attorney, Agent, or Firm* — Etherton Law Group, LLC

(57) ABSTRACT

A lightweight treadmill for walking which utilizes a short walking surface, a small and lightweight motor, strong but minimized frame design; and a remote display to make a compact, relatively lightweight and portable treadmill. In the preferred embodiment the treadmill uses. In the preferred embodiment a servomotor and pulley system to generate high-torque, thereby enabling walking at very slow speeds. The servomotor and pulley system fit within the low-profile treadmill base, eliminating the need for a housing at the front end of the treadmill. A walker may be attached to the treadmill for increased stability while walking.

18 Claims, 5 Drawing Sheets

COMPACT TREADMILL WITH WALKER

FIELD OF INVENTION

This invention relates generally to devices for aiding walking and more particularly to compact motorized treadmills.

BACKGROUND

Historically motorized treadmills have been designed to enable running at high speeds, in contrast to walking at much slower speeds. The demands to support running speeds require a heavy motor and base, and a longer belt that allows for longer step lengths during running. The belt speeds required for running require the large motor and heavy flywheel to maintain speed while under load. The long belt runs between two sidewalls of the base, each of which is wide enough for a runner's foot so that the runner can jump off the belt if it gets moving too fast or the runner loses his balance. A treadmill for running typically has a chest-high framework extending upwards from the front of the base, upon which a display is mounted for the runner to view while running, and a housing under the display for enclosing the motor. Many also have handgrips or arms that extend from the frame at chest height a short distance in front of the runner's body, but that do not extend to the side of the runner to avoid encumbering the runner's arms while they are pumping. These requirements cause all currently available motorized treadmills to be large, heavy and therefore not easily portable.

While there are health benefits to running on a treadmill, many people prefer to—or need to—walk instead of run. For those suffering gait restrictions such as weak legs or poor balance, people commonly use a walker to aid in walking. Typically a walker is an open framework of four posts which form two side supports with handgrips at about hip height, and a front crossbar that connects the two side rails, open at the rear so that the user is surrounded on three sides by the framework. To walk, the user grips the handgrips and supports some or most of his weight with his arms while moving his feet forward a step. Then he picks up the walker and moves it forward, supports his weight with his arms, and steps forward again. However, using a walker to walk any meaningful distance requires that the user physically leave the room he is in, which can be difficult in certain situations, thereby decreasing the likelihood the user will actually walk more than a few steps. A treadmill designed for walking, preferably that is also lightweight and easily movable, would provide a safe walking environment for patients in a hospital room; convalescents and others needing rehabilitation; in luxury hotels for customers who prefer to walk in their room instead of the on-site gym or unfamiliar neighborhood; for desk workers and those with other sedentary jobs; for therapists who treat different patients in different locations; and for those who would like to gain general health benefits from walking without having to roam a large area. Therefore, there is a need for a treadmill designed for walking that encourages walking and that is not constrained by the demands of a device for running.

Therefore, it is an object of this invention to provide a treadmill for walking instead of running. It is another object to provide a treadmill for walking that is safe for walkers. It is another object to provide a treadmill for walking that is compact and relatively lightweight for easy portability.

SUMMARY OF THE INVENTION

The invention described herein is a treadmill for walking which utilizes a short walking surface, a small and lightweight motor, strong but minimized frame design; and a remote display to make a compact, relatively lightweight and portable treadmill. In the preferred embodiment the treadmill uses a servo motor and pulley system to generate high-torque, thereby enabling walking at very slow speeds. The servomotor and pulley system fit beneath the walking surface within the low-profile treadmill base, eliminating the need for a housing at the front end of the treadmill. A walker may be attached to the treadmill for increased stability while walking.

DETAILED DESCRIPTION OF THE INVENTION

Figure 1:
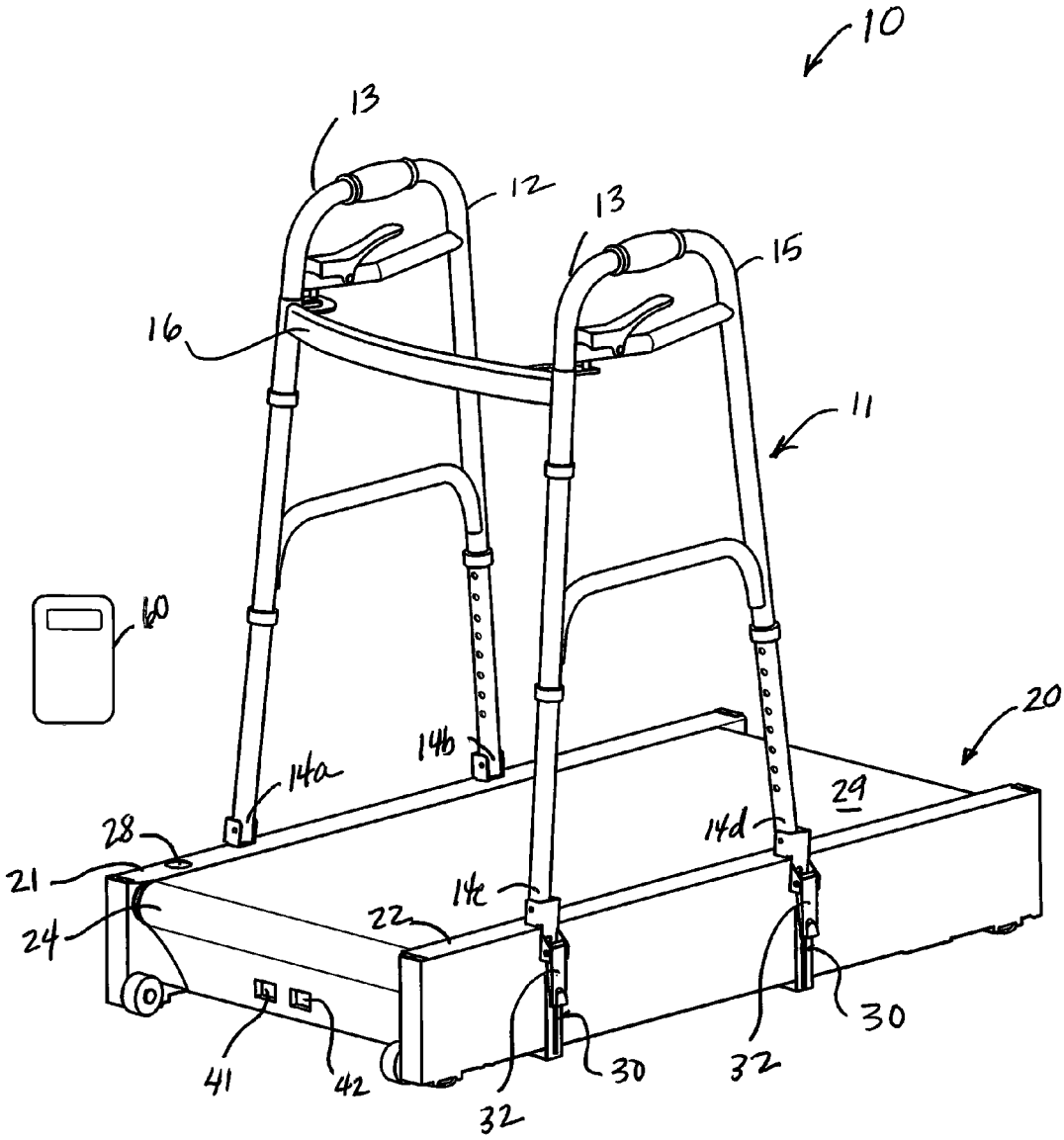
FIG. 1 is a front perspective view of one embodiment of the treadmill with a walker attached

FIG. 1 illustrates a preferred embodiment of the present invention designated generally as 10, which comprises a walker 11 and a base 20. Patients are often familiar with using a walker, and using one in cooperation with a treadmill increases the comfort level the patient has with using the treadmill, thereby improving compliance with a recommended exercise regimen.

The walker may be any walker adaptable to be attached securely to the base 20. In FIG. 1, the walker 11 has a first side support 12 having two legs and a generally horizontal portion for the user to hold referred to herein as a handgrip 13. The first side support 12 may be adjustable in height and the handgrip 13 may optionally comprise a non-slip cushion or covering. The first side support 12 has two feet 14*a* and 14*b* which are attached to a first side rail 21 of the base 20. Similarly, the walker 11 has a second side support 15 having two legs and a generally horizontal portion used as a handgrip 13, with or without a cushion or covering. The second side support 15 has two feet 14*c* and 14*d* which are attached to a second side rail 22. A generally horizontal crossbar 16 connects the first and second side support, 12 and 15, respectively. Modern walkers are adjustable in height and should be set at a height that is comfortable for the user, but that will allow the user to maintain a slight bend in his arms. A walker set at a proper height reduces stress on the user's shoulders and back during use. Preferably the top of the walker is about waist high, about 12 inches deep, and slightly wider than the user. Walkers are also available in other sizes such as smaller pediatric walkers for children or larger bariatric walkers for obese persons, and the dimensions of the device 10 may be decreased or increased as necessary to accommodate such walkers.

Figure 3:
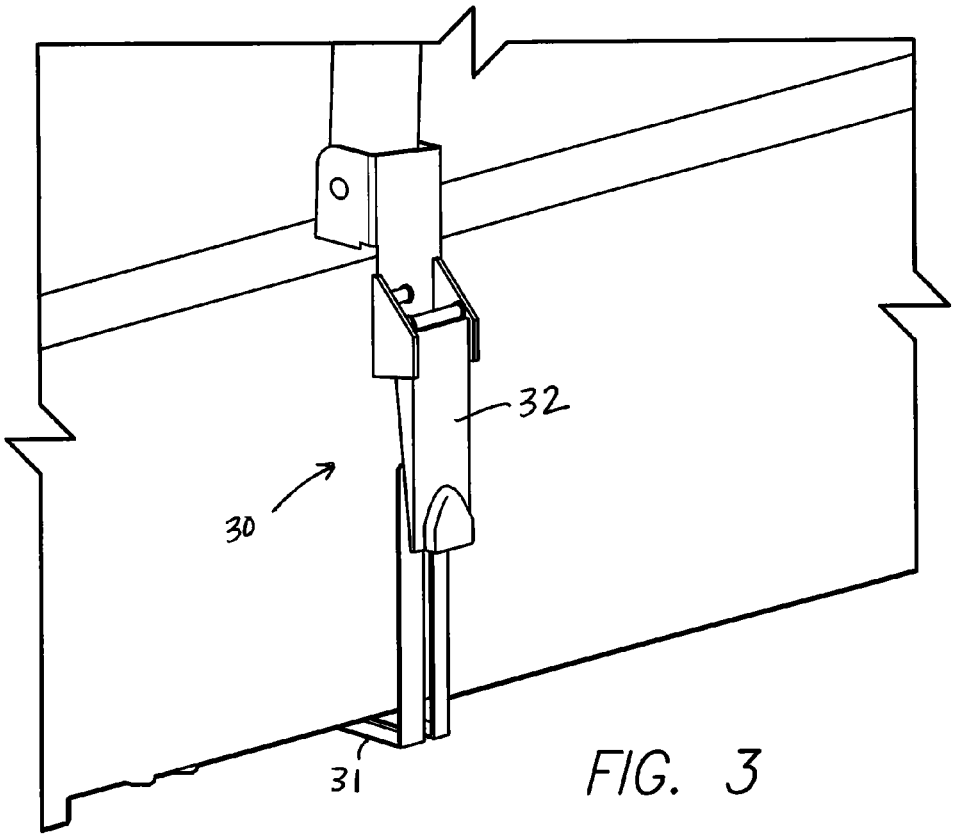
FIG. 3 is a detail view of the mechanism attaching the walker to the treadmill of FIG. 1.

The walker 11 is securely attached to the base 20. In the preferred embodiment, the walker 11 is removeably attached to the base 20 using four independent adjustable draw latch brackets 30 enabling the walker 11 to be separated from the base 20 for storage and transport, thereby reducing the weight and size of each piece to be stored and moved. The brackets 30 on walker 11 use a very small mounting surface, preferably about the same width as the side rail it's mounted to, so as to maintain a high ratio of walking surface 29 to footprint, as discussed in more detail below. FIG. 3 shows a detail view of an embodiment for a bracket 30 used for attaching each foot 14 to a side rail 21 or 22. The foot rests on the top of the side rail. Each bracket 30 is attached to and hinged at each foot 14, and rotated over the outside of the side rail until the L-shaped catch 31 of the bracket slides under the side rail. A draw latch clamp 32 tightens the bracket 30 in place. When it is time to remove the walker 11 from the base 20, the clamps 32 are unlatched and the walker 11 is lifted off.

The ratio between walking surface to overall surface ratio is important for a small footprint and portability. Factors leading to a high walking surface-to-footprint ratio include the relatively short length of the walking surface, the design of the frame including side rails that are narrow in width relative to traditional treadmills used for running, the dimensionally small motor and pulley system, and the use of a handheld remote rather than a mounted display.

The outside dimensions of a device define its footprint. For the present invention, the rectangle defined by the connected side rails defines the footprint of the device 10. To remain portable the ratio of walking surface to footprint should be as high as possible, where the walking surface 29 is the top horizontal portion of the treadmill belt. The largest step length for a typical male at a fast gait is approximately 31 inches (78 cm). The walking surface 29 of the present invention, being designed for walking, is therefore greater than that, preferably between about 31 and 40 inches. Prior art treadmills have 3-5" of frame extending beyond each side of the walking surface, plus a treadmill head and framework display that can be 12"-16" deep. The present design with no treadmill head and streamlined aluminum side rail profiles creates a footprint that is almost entirely walking surface. In the preferred embodiment the walking surface is at least about 76% of the footprint, and more preferably at least about 80%

Figure 2A:
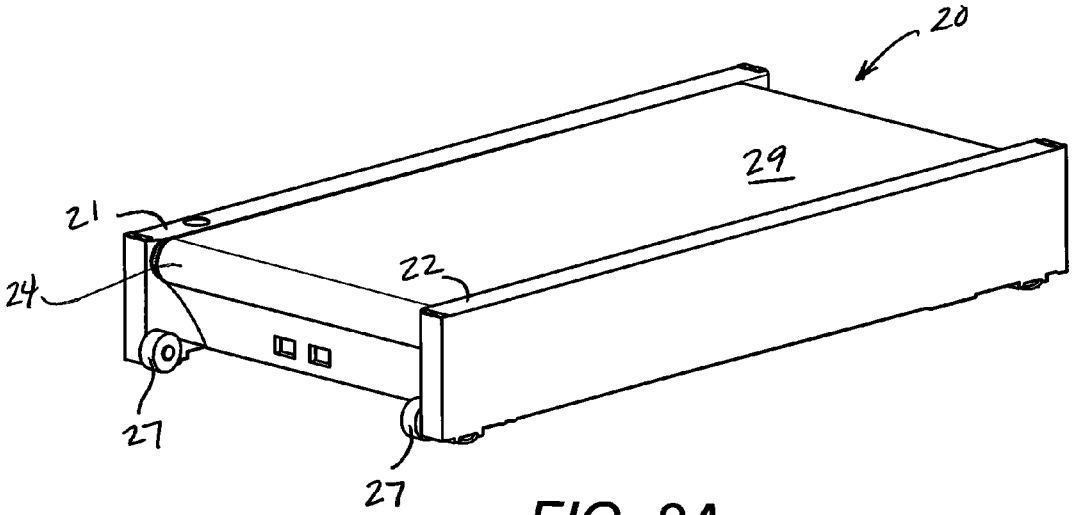
FIG. 2A is a front perspective view of one embodiment of the treadmill.
Figure 2B:
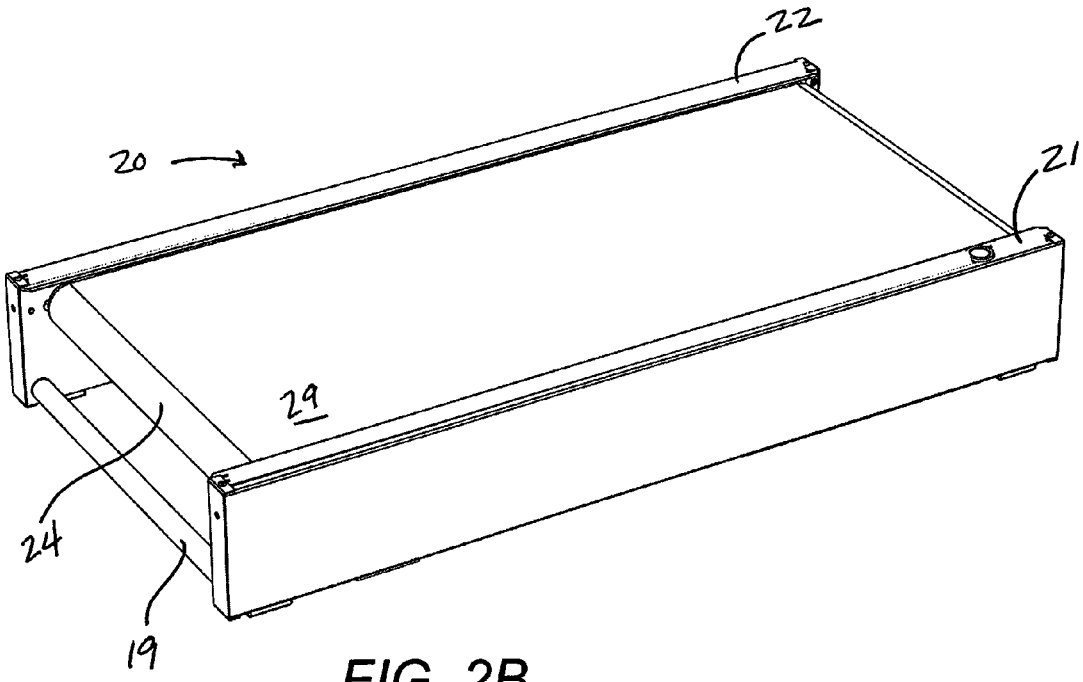
FIG. 2B is a rear perspective view of one embodiment of the treadmill.
Figure 4:
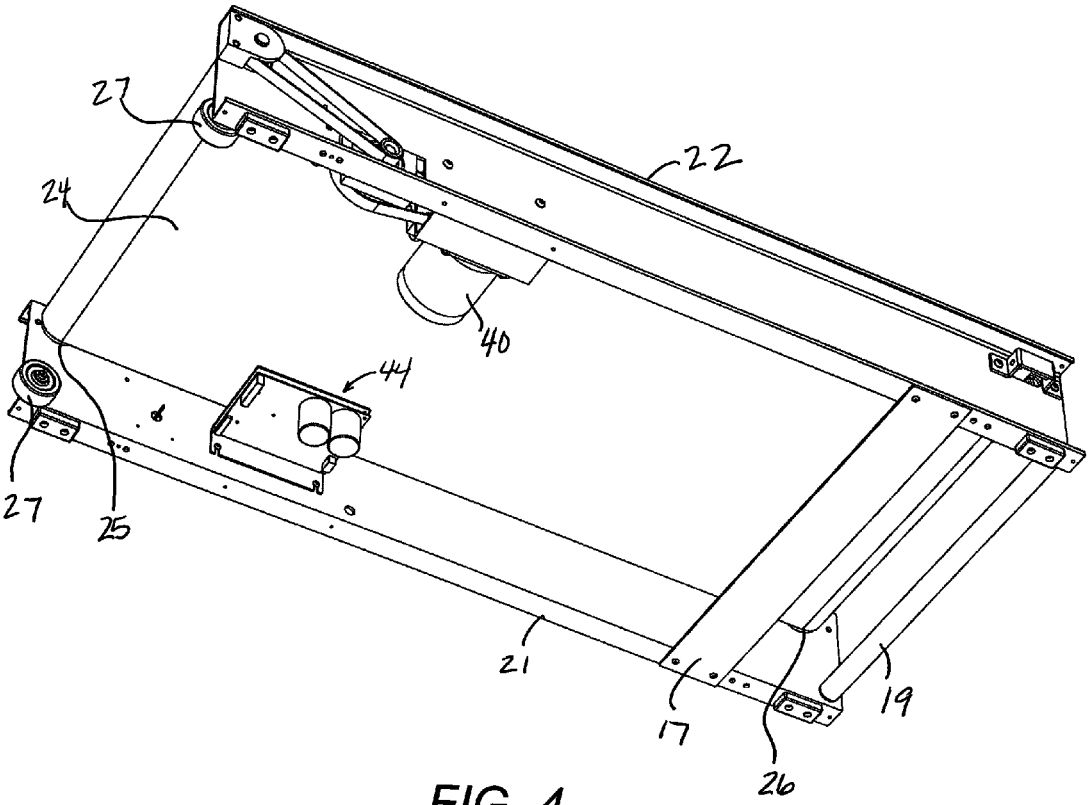
FIG. 4 is a perspective view of the bottom of the treadmill of FIG. 1.
Figure 5:
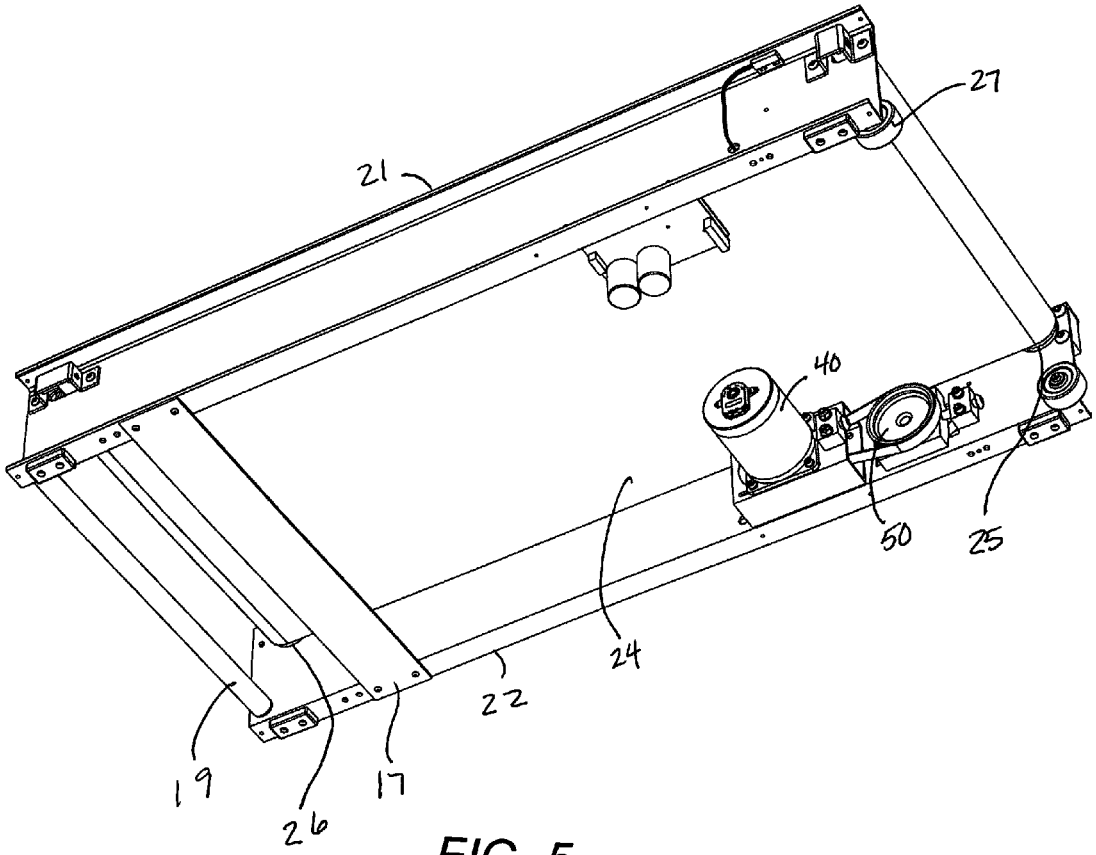
FIG. 5 is a perspective view of the bottom of the treadmill, opposite that of FIG. 4.

FIGS. 2A and 2B show the base 20, comprising a frame 23 and a treadmill belt 24. The frame 23 comprises the first side rail 21 and the second side rail 22. In the preferred embodiment the side rails 21, 22 are C-channels made of extruded aluminum, a strong, lightweight material. The width of each side rail, where width is the top of the C, is relatively narrow compared to the width of traditional treadmills' side rails, yet are nonetheless wide enough able for the feet 14 of the walker to rest stably on the side rails. The side rails 21, 22 are connected by a drive roller 25 and an idle roller 26. Preferably both are thick-walled aluminum, providing rigidity and stability without adding too much additional weight. FIGS. 4 and 5 show the underside of the base 20, where it can be seen that the treadmill belt 24 encircles the drive roller 25 and the idle roller 26.

When walking the user requires space in front for toe clearance. Preferably there is no cross-piece between the side rails 21, 22 in the front of the base other than the drive roller 25, which sits below the walking surface 29, leaving the front open and minimizing the weight of the frame 20. The open-end design increases the effective useful length of the treadmill belt 24 with minimum overall length of the base 20. At least two wheels 27 are attached to the bottom of the base 20 to make it easier to transport from location to location, preferably one wheel at the front end of each side rail. A cross-piece 17 may be used between the side rails, 21, 22 under the walking surface to increase dimensional stability, and if used is preferably placed on the bottom of the base 20, as shown in FIGS. 4 and 5. A tote bar 19 may also be positioned between the side rails, 21, 22 to facilitate pulling the base 20 from one room to another. Advantageously, the tote bar 19 also increases dimensional stability of the device 10.

The base 20 also comprises receptacles 28, 29, and 50 for a magnetic safety key, power cord, and handset cord, respectively. As a safety precaution the magnetic safety key should be sitting in its receptacle 28 in order to power the treadmill 10. Device 10 is preferably powered by mains by attaching a power cord to power receptacle 41, but may also be battery to increase portability.

A motive device to drive the treadmill belt fits within the footprint of the device and under the treadmill belt 24. Treadmills designed for rehabilitation or walking must have the ability to start slowly while the patient is standing on the belt, because the patients cannot physically stand to the side of the belt as it starts or balance well enough to withstand the momentum shift of a quick start while standing on the belt before it starts. High torque is required to smoothly initiate movement of the belt while loaded by a patient's weight. Therefore, to overcome this friction at the startup, the motor should provide higher torque than what is required at normal operating speeds. The peak torque output of some electric motors at low speeds may be very high, but requires a larger current. This often means the motor or drive would need to operate outside of thermal limits to maintain the low speed under heavy, cyclical load. Many prior art treadmills have smaller motors that cannot maintain this high torque and accommodate this deficiency with higher start speeds that require the user to step off the belt when starting. Existing commercial and rehab treadmills provide this high torque at start up by using a motor that is about 2-3 times more powerful than the power needed to support running—therefore they become extremely bulky and heavy.

In contrast, in the present invention the treadmill belt 24 is driven by a small and relatively lightweight motor. In the preferred embodiment, an efficient brushless DC servo motor is connected to the drive roller 25 using a reduction system to create the high torque required to start the treadmill smoothly under the load of a patient. Brushless DC motors have higher torque and power densities than brushed motors, yielding more torque and power in a smaller and lighter package. This significantly lowers the size of the motor required relative to existing treadmills and allows the motor to be mounted under the belt, eliminating the need for a treadmill head. Those two factors, in combination with the reduction system described below, significantly reduce the weight of the device 10.

For precise speed control the servo motor 40 is in communication with an encoder (not shown) that provides feedback about the speed of the motor. The torque of the motor coupled with the high resolution encoder feedback eliminates the need for a heavy flywheel to control the speed. Given that a typically flywheel is also so large that it cannot be mounted under the walking surface, eliminating the flywheel is doubly advantageous because it reduces the weight and size of the device 10 over existing treadmills.

Traditional treadmills typically use a pulley reduction of 2-3:1, depending on the size of the drive roller. By eliminating the higher running speeds, a lower-powered motor is required, and the necessary torque output is reached by means of the larger speed reduction ratio. The reduction system of the present invention may incorporate any of various mechanical power transmission technologies including gearboxes or belt and pulley systems to reduce the rotational output speed of the motor 40 to a desired rotational speed of the treadmill belt 24. In the preferred embodiment the motor 40 is rated for a no-load speed of about 5000 rpm, but only about half of the motor speed is used, peaking at 2430 rpm with the treadmill belt 24 moving at about 3.0 mph. For safety reasons the top speed is limited to about 3.0 mph since the walking surface 29 is short. The preferred embodiment uses a reduction system of pulleys and serpentine belts. There are two stages of the pulley speed reduction. Both stages use drive pulleys (not shown) with 1" diameters. The first stage is a reduction of about 3.25:1 (driven intermediate pulley 50 diameter is 3.25") and the second stage is a reduction of about 1.6:1 (roller pulley diameter is 1.6").

In another embodiment, a gear motor is connected to the drive roller 25 using a reduction system. The gear motor is a brushed DC motor with a spur or worm gearbox fitted to the motor shaft. This gearbox reduces the rotational speed of the output shaft relative to the motor while increasing the torque. This design enables use of a less expensive speed controller than the servo motor, but due to power losses in the gearbox and inferior power generation of a brushed motor, it requires a larger, heavier motor-gearbox combination to achieve the same output torque and speed as the servo motor with pulley and belt speed-reduction. However, for slower treadmills, such as those for pediatric patients, this provides an acceptable lower-cost alternative.

The device 10 is operated by an electronic handset 60 that is connected by wire or wirelessly to the device 10. Unlike traditional treadmills, the handset 60 is not fixed to the treadmill 10 and instead moves freely, which eliminates a traditional component of the treadmill framework, thus reducing its size. The handset 60 is in communication with control circuitry 44 that receives input from the handheld remote and from the encoder, and provides the appropriate control to speed up, or reduce speed of the motor. Once the user is standing on the walking surface 29, the user or therapist switches the on/off button to turn on the motor to start the treadmill belt 24 turning slowly, at initial default speed of 0.1 mph. The speed of the walking surface is controllable with the handset 60 at speeds variable between 0 and about 3 mph. In the preferred embodiment, the display on the handset rotates between displaying speed, time and distance, approximately 5 seconds each. Speed is displayed in 0.1 mph (or 0.2 kph) increments and distance is displayed in feet (or meters) rather than miles due to the slow speeds. The display automatically switches to display the speed if the speed is changed. The system resets to 0.1 mph whenever it is turned off.

The device 10 can be used with the walker as described above, under other rehabilitation equipment such as the Litegait® gait therapy devices, or simply as a stand-alone treadmill. The portability, small size, and light weight of the device 10 make it particularly useful for home health rehabilitation purposes; moving it from room to room between multiple users; and storage in home, office, clinic, and hospital settings, such as under a bed, couch, or desk. The small footprint is also advantageous for use in busy rehabilitation clinics, particularly those that have relatively small amount of space to store all the rehab equipment.

While there has been illustrated and described what is at present considered to be the preferred embodiment of the present invention, it will be understood by those skilled in the art that various changes and modifications may be made and equivalents may be substituted for elements thereof without departing from the true scope of the invention. Therefore, it is intended that this invention not be limited to the particular embodiment disclosed, but that the invention will include all embodiments falling within the scope of the appended claims.

We claim:

1. A treadmill having wheels, the treadmill for walking comprising:

a) a frame, wherein the frame further comprises two side rails connected by a belt driver and a belt roller;

b) a treadmill belt having a top horizontal surface operable within the frame; and c) a motor operably connected to the treadmill belt for moving the treadmill belt, wherein the motor is disposed under the top horizontal surface; and wherein no part of the treadmill except for the wheels, extends beyond a volume defined by the connected side rails, the top horizontal surface, and a surface the frame is sitting on.

2. The treadmill according to claim 1 wherein the top horizontal surface area of the treadmill belt is at least about 76% of the top horizontal surface area of the treadmill.

3. The treadmill according to claim 1 further comprising a walker attached to the frame.

4. The treadmill according to claim 3 further comprising one or more brackets that removeably attach the walker to the frame.

5. The treadmill according to claim 1 wherein the motor is a servo motor that is not connected to a flywheel.

6. The treadmill according to claim 5 further comprising a reduction system which works in cooperation with the servo motor to reduce the rotational output speed of the servo motor.

7. The treadmill according to claim 6 wherein the reduction system comprises one or more pulley belts and pulleys.

8. The treadmill according to claim 1 further comprising a walker removeably attached to the frame with one or more brackets wherein each bracket is about the same width as one of the side rails.

9. A treadmill having wheels, the treadmill for walking comprising:

a) a base comprising a frame and a treadmill belt; wherein i. the frame comprises a first side rail and a second side rail, ii. the first and second side rails are connected with a belt driver between a first end of the first side rail and a first end of the second side rail, iii. the first and second side rails are connected with-a belt roller between a second end of the first side rail and a second end of the second side rail;

iv. the first and second side rails have a first top and second top, respectively;

v. wherein the treadmill belt encircles the belt driver and the belt roller;

vi. wherein the out side dimensions of the rectangle defined by the connected side rails define a footprint;

vii. wherein the footprint, a top horizontal surface defined by the first and second tops, and a surface the frame is sitting on define a volume; and b) a motive system for moving the treadmill belt, wherein the motive system is disposed within the volume;

wherein no part of the treadmill except for the wheels, extends beyond the volume.

10. The treadmill according to claim 9 wherein a walking surface comprises the top horizontal portion of the treadmill belt and wherein the walking surface is at least about 76% of the footprint.

11. The treadmill according to claim 9 further comprising a walker attached to the frame.

12. The treadmill according to claim 9 further comprising a walker removeably attached to the frame with one or more brackets wherein each bracket is about the same width as the first or second side rail.

13. The treadmill according to claim 9 further comprising a walker, wherein the walker comprises:

a) a first side support having a handgrip and two feet;

b) a second side support having a handgrip and two feet; and c) a crossbar connecting the first and second side supports;

d) wherein the feet of the first side support are attached to the top of the first side rail and the feet of the second side support are attached to the top of the second side rail.

14. The treadmill according to claim 13 wherein the feet of the first side support are removeably attached to the top of the first side rail and the feet of the second side support are removeably attached to the top of the second side rail.

15. The treadmill according to claim 13 wherein the feet of the first and second side supports are removeably attached to the top of the first and second side rails with quick-release clamps.

16. The treadmill according to claim 9 wherein the motive system comprises a servo motor connected to a reduction system which turns the belt driver, wherein the motive system does not employ a flywheel.

17. The treadmill according to claim 16 wherein the servo motor is disposed under the belt and between the belt driver and the belt roller.

18. The treadmill according to claim 16 wherein the reduction system comprises one or more pulley belts and pulleys.

* * * * *